US008701230B2

(12) United States Patent
Zerhusen et al.

(10) Patent No.: US 8,701,230 B2
(45) Date of Patent: Apr. 22, 2014

(54) CORE INSTABILITY SYSTEM

(75) Inventors: Robert M. Zerhusen, Cincinnati, OH (US); John Sparkman, Oakwood, OH (US); Charles A. Howell, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 209 days.

(21) Appl. No.: 13/280,622

(22) Filed: Oct. 25, 2011

(65) Prior Publication Data

US 2013/0103421 A1 Apr. 25, 2013

(51) Int. Cl.
*A61G 7/05* (2006.01)

(52) U.S. Cl.
USPC ..... 5/612; 5/731; 5/733; 5/715; 5/615

(58) Field of Classification Search
USPC ..... 5/612, 615, 710, 713, 715, 731, 733, 5/513
See application file for complete search history.

(56) References Cited

U.S. PATENT DOCUMENTS 3,935,604 A * 2/1976 Collins ..... 5/630
4,791,687 A * 12/1988 Iwase ..... 5/708
5,092,007 A * 3/1992 Hasty ..... 5/715
6,094,762 A 8/2000 Viard et al.
6,912,749 B2 7/2005 Thomas et al.
7,228,581 B2 * 6/2007 Mezue ..... 5/713
7,833,144 B1 11/2010 Como et al.
8,146,187 B2 * 4/2012 Lachenbruch et al. ..... 5/612
2005/0137506 A1 6/2005 Chow
2008/0077059 A1 3/2008 Morikawa et al.

FOREIGN PATENT DOCUMENTS

EP 1974709 A1 10/2008
WO 2004009183 A2 1/2004
WO 2006116859 A1 11/2006

OTHER PUBLICATIONS

Partial European Search Report for EP12189233; Place of Search—Munich; Date of Completion of the Search—Jan. 13, 2013.

* cited by examiner

*Primary Examiner* — Michael Trettel
(74) *Attorney, Agent, or Firm* — Barnes & Thornburg LLP

(57) ABSTRACT

A system to cause instability for a person supported by a person support surface is disclosed. The system is configured to cause the person supported by the person support surface to compensate for the instability caused by the system in order to exercise their core or trunk region.

26 Claims, 8 Drawing Sheets

CORE INSTABILITY SYSTEM

BACKGROUND

While several systems have been developed to help a patient supported by a patient support apparatus to exercise, a need exists for continued development in this area.

BRIEF SUMMARY

The present disclosure includes one or more of the features recited in the appended claims and/or the following features which, alone or in any combination, may comprise patentable subject matter.

One embodiment of the current disclosure of the system includes a person support surface comprising a ticking layer with an outer facing surface and an inner facing surface, the inner facing surface defining an internal core region. An instability apparatus is mounted to the person support surface.

Another embodiment of the current disclosure of the system includes a person support apparatus. A fluid supply unit is mounted to the person support apparatus. An instability apparatus is in fluidic communication with the fluid supply unit.

Another embodiment of the current disclosure of an instability apparatus for use on a person support apparatus comprising a controller and a source of pressurized fluid, the instability apparatus comprising at least one bladder in fluidic communication with the source of pressurized fluid and a connector in the fluidic path between the bladder and the source of pressurized fluid.

Yet another embodiment of the current disclosure of an instability apparatus for a person support surface includes at least two bladders. A fluid supply unit is in fluidic communication with at least one bladder. At least one valve is fluidly connected to at least one bladder. A controller in communication with at least one of the fluid supply unit and the valve to vary the volume of fluid in at least one bladder. Thereby, varying the inclination of the person support surface to cause instability.

BRIEF DESCRIPTION OF THE DRAWINGS

The accompanying drawings incorporated in and forming a part of the specification illustrate several aspects of the claimed subject matter and, together with the description, serve to explain the principles of the claimed subject matter. In the drawings:

DETAILED DESCRIPTION

Figures 1A, 1B, 1C:
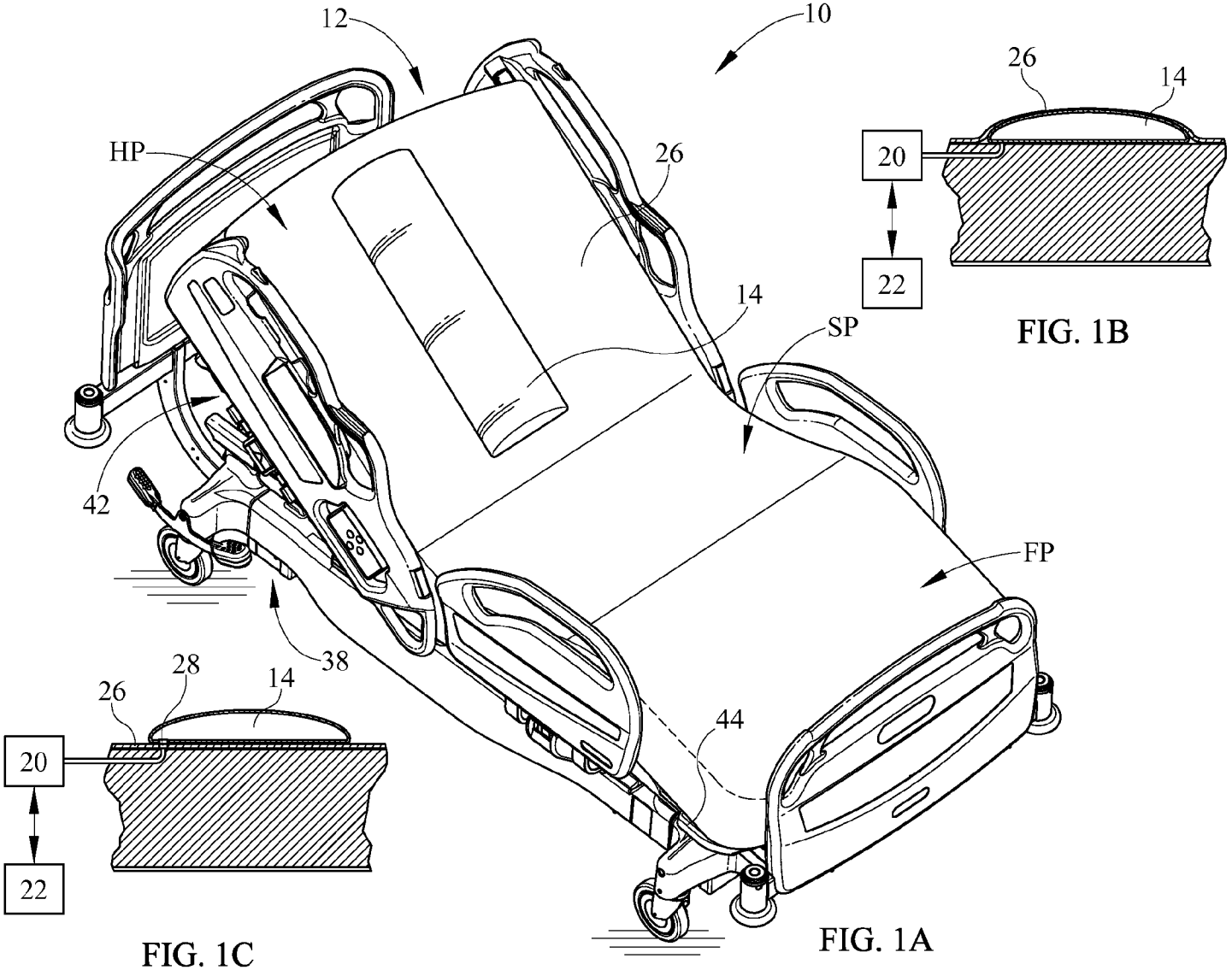
FIG. 1A is an illustration of a system to exercise a person's core region, wherein an instability apparatus includes a section of a cylinder and is incorporated with the head support section of a person support surface, constructed according to principles of the teachings herein.
FIG. 1B is a cross-sectional view of the system of FIG. 1A, wherein an instability apparatus is positioned under a ticking layer of a person support surface.
FIG. 1C is a cross-sectional view of the system of FIG. 1A, wherein an instability apparatus is positioned over a ticking layer of a person support surface.

The embodiments of the claimed subject mater and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be briefly mentioned or omitted so as to not unnecessarily obscure the embodiments of the claimed subject matter described. The examples used herein are intended merely to facilitate an understanding of ways in which the claimed subject matter may be practiced and to further enable those of skill in the art to practice the embodiments of the claimed subject matter described herein. Accordingly, the examples and embodiments herein should not be construed as limiting the scope of the claimed subject matter, which is defined solely by the appended claims and applicable law. Moreover, it is noted that like reference numerals represent similar parts throughout the several views of the drawings.

It is understood that the subject matter claimed is not limited to the particular methodology, protocols, devices, apparatus, materials, applications, etc., described herein, as these may vary. It is also to be understood that the terminology used herein is used for the purpose of describing particular embodiments only, and is not intended to limit the scope of the claimed subject matter. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art.

Figure 2:
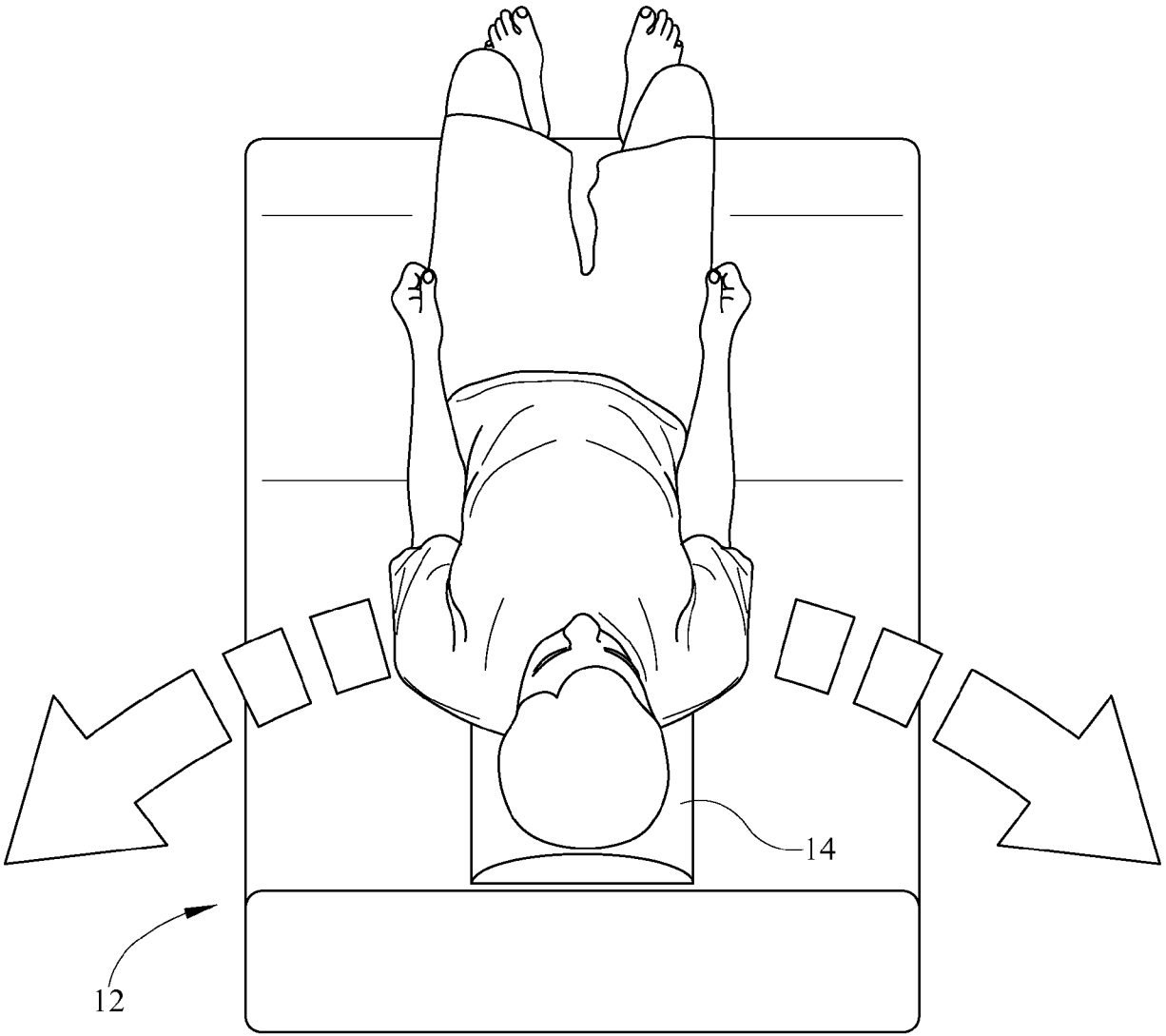
FIG. 2 is an illustration of a person supported by the system of FIG. 1 configured to exercise the person's core region, constructed according to the teachings herein.
Figure 3:
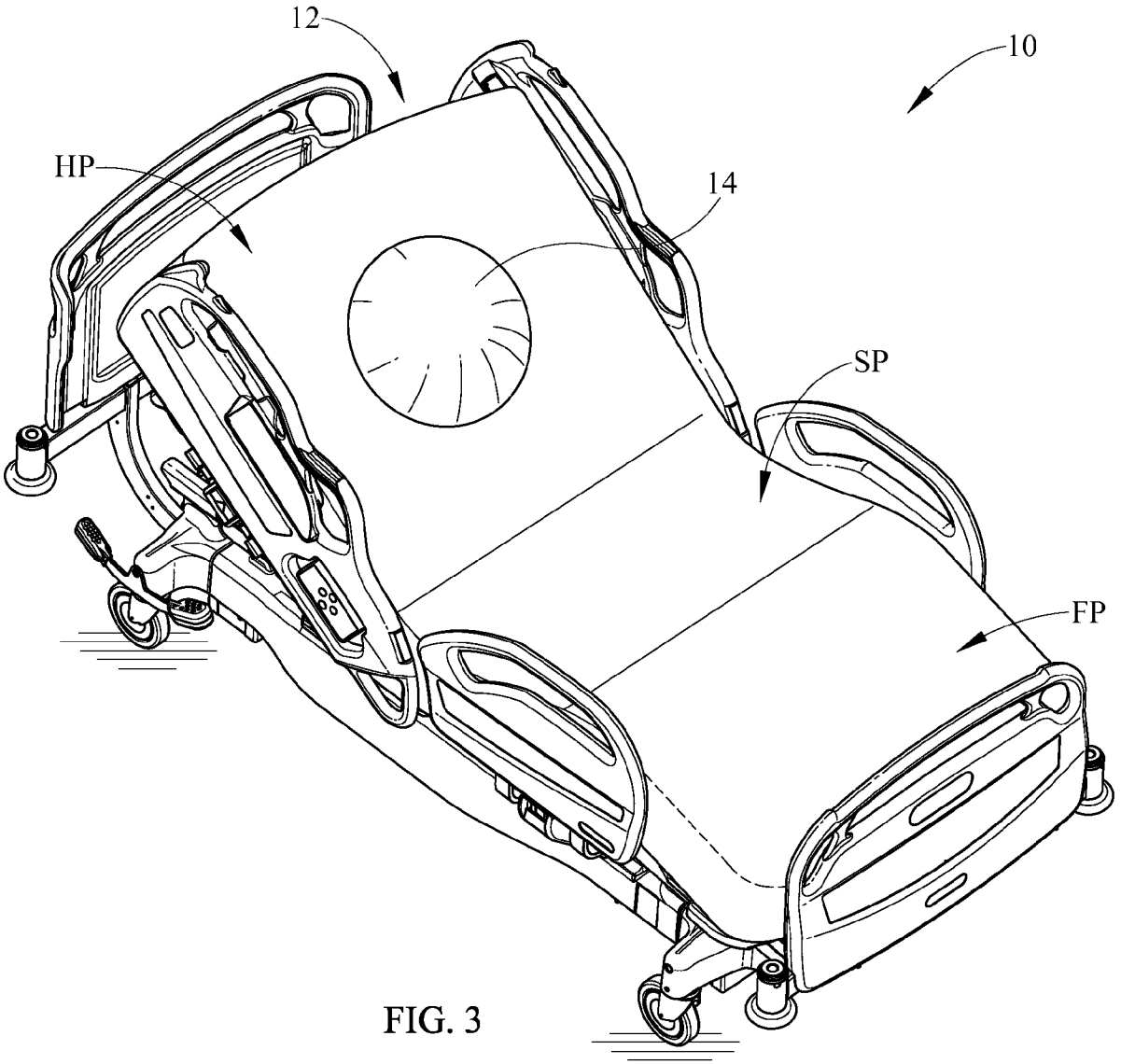
FIG. 3 is an illustration of a system to exercise a person's core region, wherein an instability apparatus is a section of a sphere and incorporated with the head support section of a person support surface, constructed according to principles of the teachings herein.

A person-support apparatus 10 according to one illustrative embodiment of the current disclosure is shown in FIG. 1A. In one embodiment, the person-support apparatus 10 is a hospital bed. The person-support apparatus 10 includes a lower frame or base 38, a plurality of supports coupled with the lower frame 38, and an upper frame 42 supported on the plurality of supports above the lower frame 38. The person-support apparatus 10 also includes a deck 44 supported on the upper frame. The person-support apparatus 10 may be a stretcher or an operating table in another embodiment. A person support surface 12 comprising an outer ticking layer 26 which envelopes an inner core region is mounted on at least a portion of the deck 44 of the person-support apparatus 10. The person support surface 12 has a head support section HP, a seat support section SP and a foot support section FP as shown in FIG. 1A. An instability apparatus 14 is positioned in the head support section HP in one embodiment as shown in FIG. 1A, FIG. 2 and FIG. 3. The instability apparatus 14 includes at least one bladder filled with air. In another embodiment, the bladder is filled with a gel substance, in yet another embodiment the bladder is filled with beads. The bladder in the instability apparatus 14 could be filled with any other medium. The instability apparatus 14 is made of foam, rubber, wood, composite or plastic materials and in one embodiment may not have a bladder, the structural strength of the instability apparatus 14 provided by the stiffness of the materials and structural design. As seen in FIG. 1A, the instability apparatus 14 is positioned along the length of the head support section HP of the person support surface 14 and is a cylindrical cap in shape. The instability apparatus 14 may alternatively be in the shape of a spherical cap as shown in FIG. 3 and FIG. 5. In another embodiment, the instability apparatus 14 may be of any other shape with at least one convex surface, where the convex surface is in contact with the patient. FIG. 4A, FIG. 4B, FIG. 5, FIG. 6A and FIG. 6B are illustrative embodiments wherein the instability apparatus 14 is positioned in the seat support section SP.

An illustrative embodiment of the current disclosure as seen in FIG. 1B shows a cross-sectional view of a person support surface 14 comprising an outer ticking layer 26 which envelopes an inner core region. In one embodiment, the ticking layer 26 is integral to the person support surface 14, while in another embodiment, the ticking layer 26 maybe a mattress cover or a bed sheet. The instability apparatus 14 as shown in FIG. 1B comprises a bladder positioned under the ticking layer 26. A fluid supply unit 20 is fluidly connected to the bladder, and inflates or deflates the bladder. Operation of the fluid supply unit 20 is controlled by the controller 22.

An illustrative embodiment of the current disclosure as seen in FIG. 1C shows a cross-sectional view of a person support surface 14 which comprises an outer ticking layer 26 which envelopes an inner core region. The instability apparatus 14 as shown in FIG. 1C comprises a bladder positioned over the ticking layer 26. A fluid supply unit 20 is fluidly connected to the bladder, and inflates or deflates the bladder via connectors 28. Operation of the fluid supply unit 20 is controlled by the controller 22. In one embodiment the instability apparatus 14 is removably mounted on the person support surface 12, and the connectors 28 serve as a quick disconnect connection allowing the instability apparatus 14 to be easily connected to or detached from the fluid supply unit 20. In yet another embodiment, the bladder of the instability apparatus 14 may be integral to the ticking layer 26.

An illustrative embodiment of the current disclosure as seen in FIG. 2 shows the instability apparatus 14 in use. The instability apparatus 14 has its convex surface supporting the patient and which causes the patient to tend to fall to one side or the other of the instability apparatus 14. The patient's attempt to maintain an upright position causes the patient to use and thereby exercise their core or trunk region. Targeted use of muscles in the core or trunk region aspires to prevent muscle atrophy and increase muscle strength, thereby enhancing patient mobility in and out of bed.

Figure 4A:
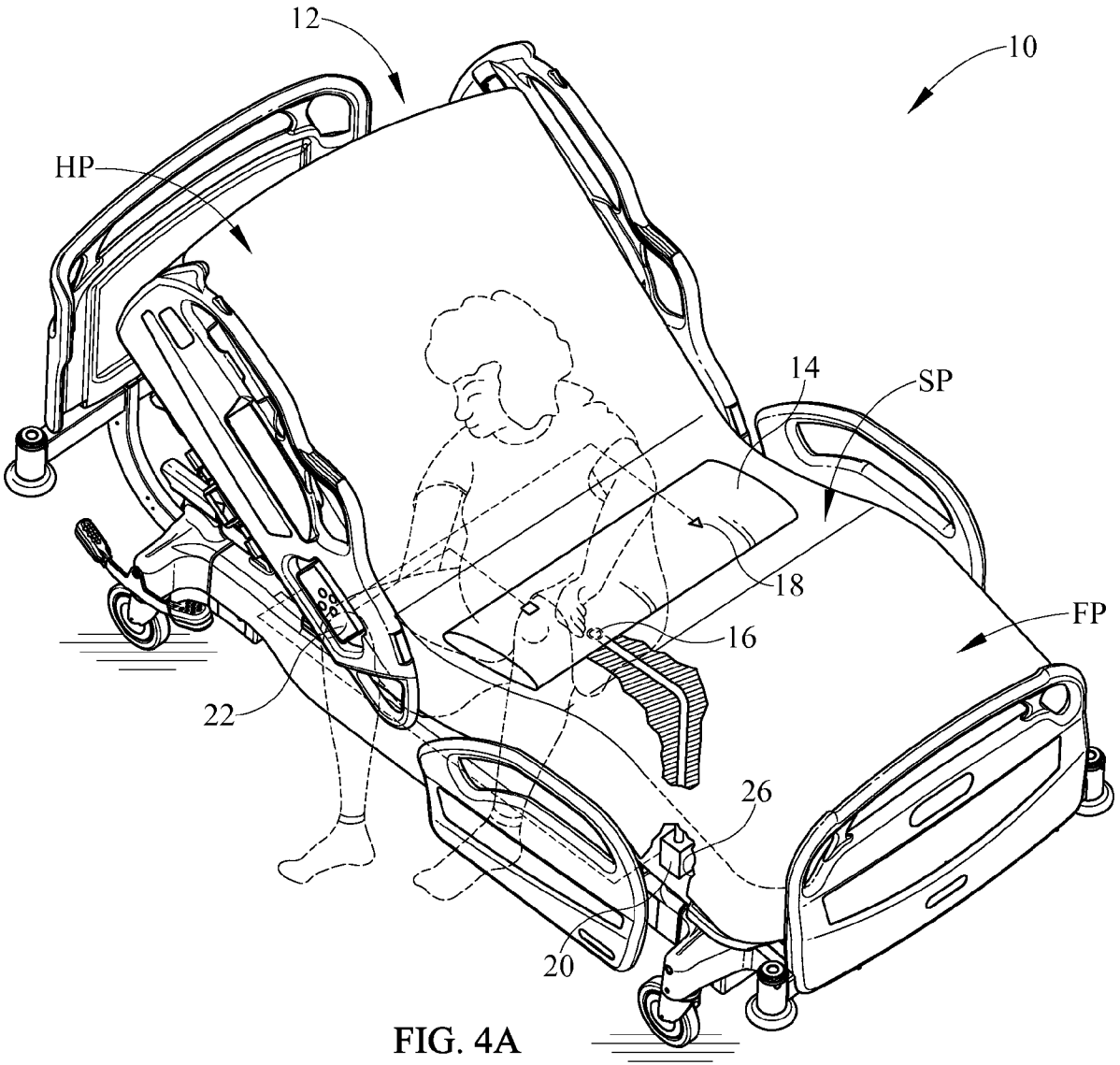
FIG. 4A is an illustration of a system to exercise a person's core region, wherein an instability apparatus is a section of a cylinder integral with the seat support section of a person support surface, constructed according to principles of the teachings herein.
Figure 5:
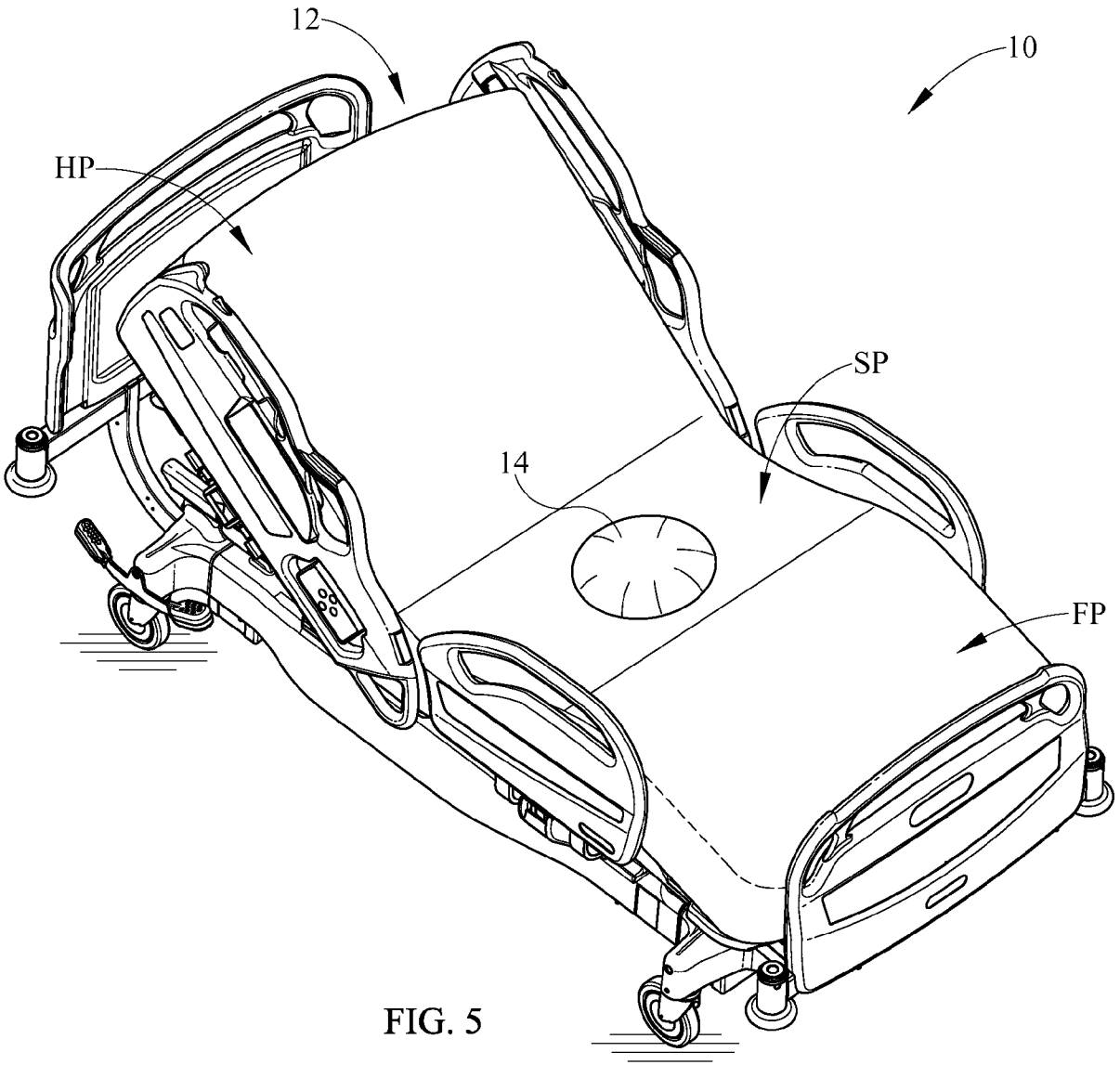
FIG. 5 is an illustration of a system to exercise a person's core region, wherein an instability apparatus is a section of a sphere and incorporated with the seat support section of a person support surface, constructed according to principles of the teachings herein.

In an illustrative embodiment of the current disclosure as seen in FIG. 4A, the instability apparatus 14 comprises at least one bladder which is variably inflated by a fluid supply unit 20. The instability apparatus 14 is mounted on the outer surface of an outer ticking layer 26 of a person support surface 12 in one embodiment. The instability apparatus is mounted between the outer ticking layer 26 and the inner core region in another embodiment, or is integral to the outer ticking layer 26 of the person support surface 12 in yet another embodiment. The instability apparatus 14 is supplied fluid by the fluid supply unit 20 integral to the person-support apparatus 10 which may be used for other operations such as inflating or deflating the person support surface 12. In another embodiment, the instability apparatus 14 has a dedicated fluid supply unit 20. A valve 16 regulates fluid flow out of the instability apparatus in one embodiment while in another embodiment; the valve 16 regulates fluid flow both in to and out of the instability apparatus 14. The valve 16 is manually operated or a controller 22 may control the operation of the valve 16 in another embodiment. The controller 22 controls the fluid supply unit 20 and therefore controls the volume and pressure inside the bladder of the instability apparatus 14. The controller 22 is integral to the person-support apparatus 10 in one embodiment and responsible for controlling other functions of the person-support apparatus 10 while in another embodiment the instability apparatus 14 has a dedicated controller 22. A pressure sensor 18 is mounted in the bladder and sends signals indicative of the pressure inside the bladder to the controller 22. In another embodiment, the pressure sensor 18 may be mounted external to the bladder. In the illustrative embodiment as seen in FIG. 4A, the instability apparatus 14 is positioned in the seat section and allows for core strengthening while the patient is seated in the bed ingress-egress position. The controller 22 may be any programmable or pre-programmed device capable of providing or acquiring control signals.

Figure 4B:
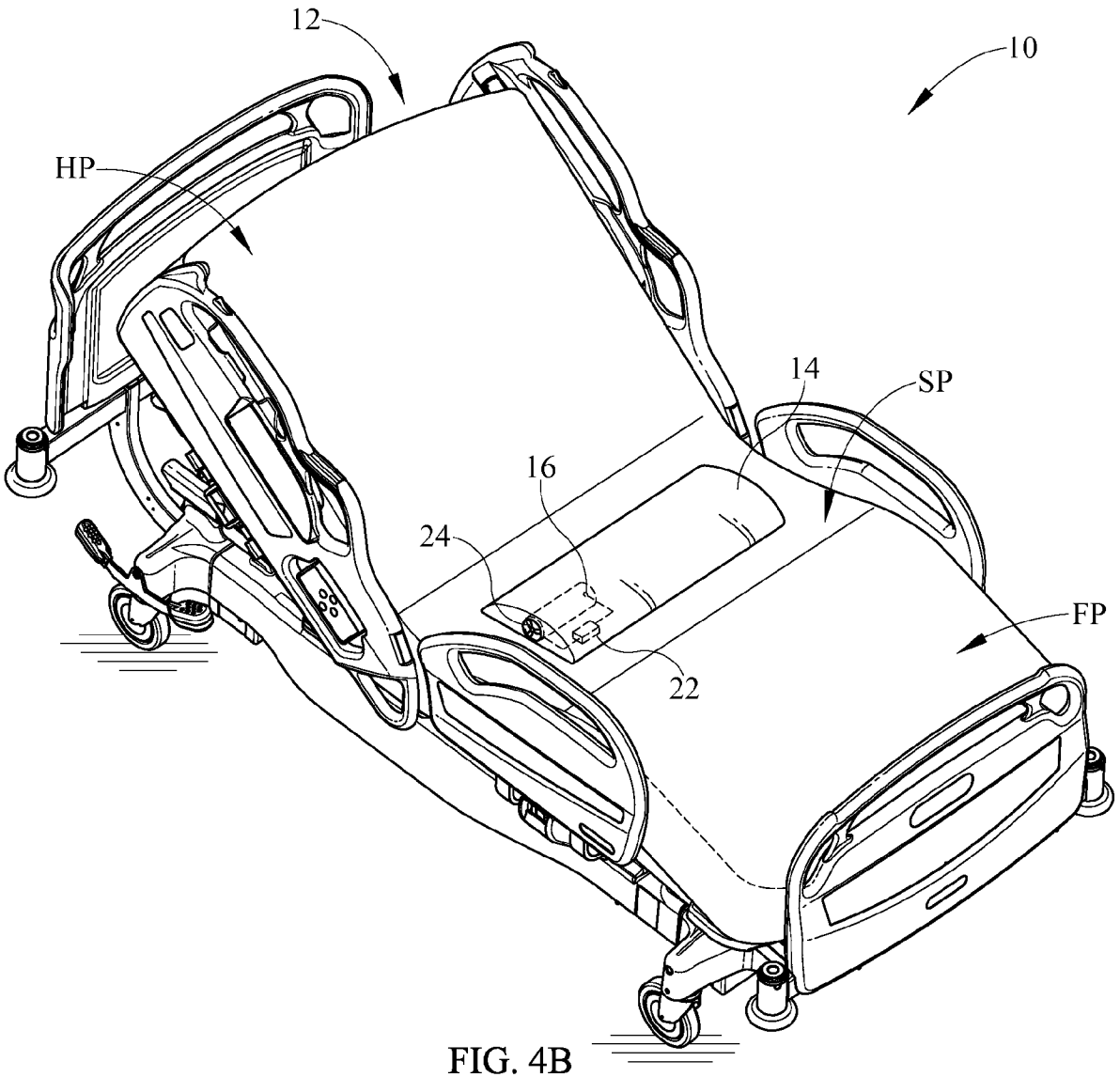
FIG. 4B is an illustration of a modular system to exercise a person's core region, wherein an instability apparatus is a section of a cylinder mounted on top of a person support surface, constructed according to principles of the teachings herein.

In an illustrative embodiment of the current disclosure as seen in FIG. 4B, the instability apparatus 14 comprises at least one bladder which is variably inflated by a blower 24. The instability apparatus 14 is a modular self contained unit and is mounted on the person support surface 12 in the seat support section SP. In another embodiment, the instability apparatus 14 may be mounted in either the head support section HP or the foot support section FP. The modular instability apparatus 14 as shown in FIG. 4B is mounted to the person support surface 12 by a hook and loop connection in one embodiment. In another embodiment, the modular instability apparatus 14 may be mounted to the person-support surface 12 by an adhesive connection, zippered connection, buttoned connection, frictional connection, snap connection or a threaded connection. As seen in FIG. 4B, the instability apparatus 14 further comprises a controller 22 which controls the operation of the blower 24. A valve 16 regulates fluid flow out of the instability apparatus 14 while in another embodiment; the valve 16 regulates fluid flow both in to and out of the instability apparatus 14. The valve 16 is a manually operated device in one embodiment while in another embodiment; the controller 22 controls the operation of the valve 16.

Figure 6A:
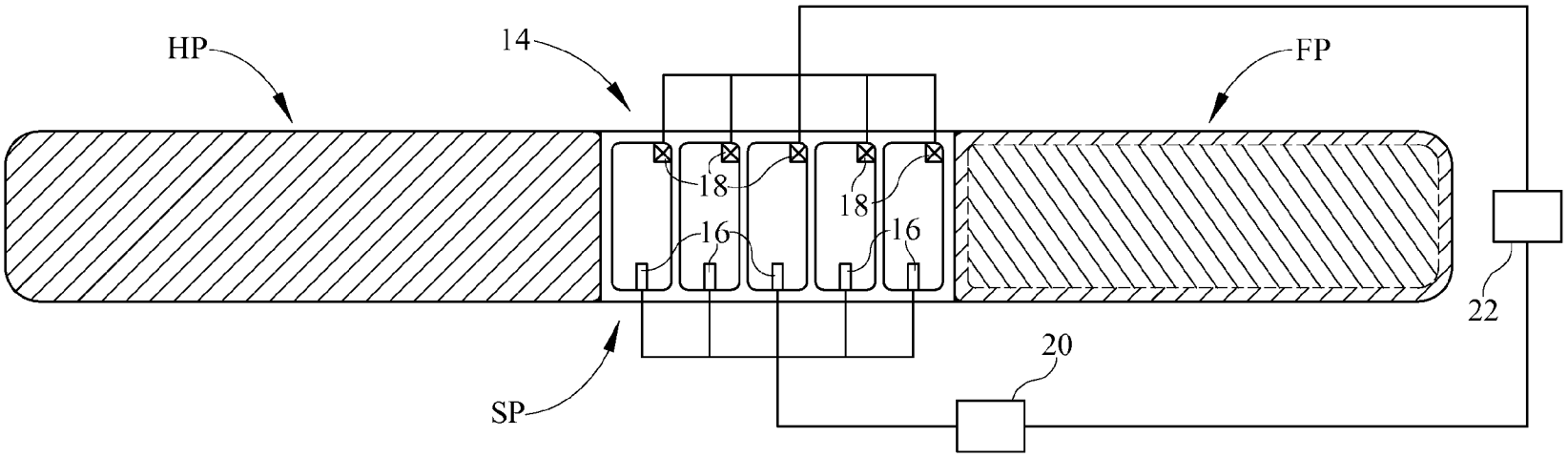
FIG. 6A is an illustration of a system to exercise a person's core region, wherein pressure within at least one bladder is varied to vary inclination of a person support surface, constructed according to principles of the teachings herein.
Figure 6B:
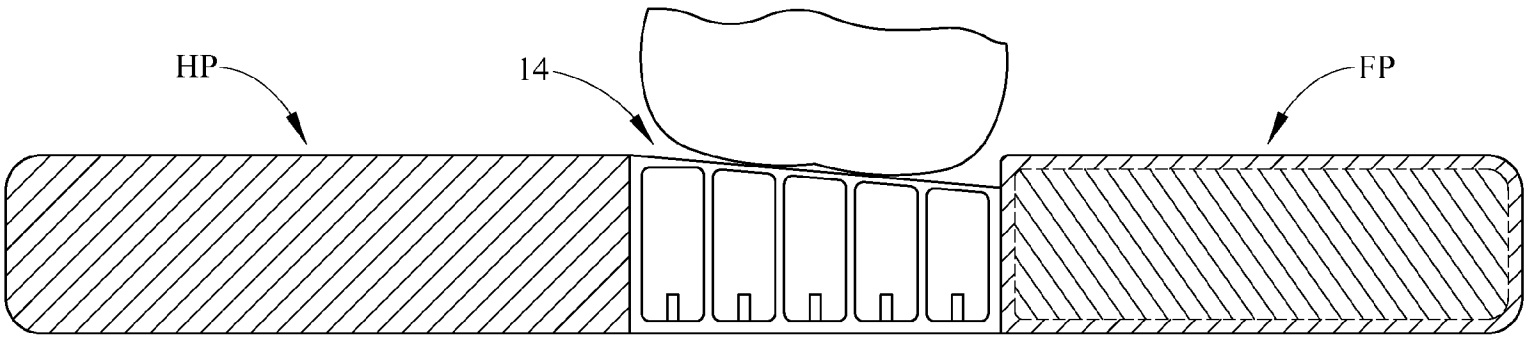
FIG. 6B is an illustration of a person supported by the system of FIG. 6A configured to exercise the person's core region, constructed according to the teachings herein.

In one illustrative embodiment of the disclosure as seen in FIG. 6A and FIG. 6B, the seat support section SP of the person support surface 12 comprises at least two bladders. A pressure sensor 18 is mounted in at least one bladder and sends signals indicative of the pressure inside the bladder to the controller 22. In another embodiment, the pressure sensor 18 may be mounted external to the bladder. The instability apparatus 14 is supplied fluid by the fluid supply unit 20 integral to the person-support apparatus 10 which may be used for other operations such as inflating or deflating the person support surface 12 in one embodiment. In another embodiment, the instability apparatus 14 has a dedicated fluid supply unit 20. A valve 16 regulates fluid flow out of the instability apparatus; in another embodiment the valve 16 regulates fluid flow both in to and out of the instability apparatus 14. The valve 16 is a manually operated device in one embodiment and in another embodiment, a controller 22 controls the operation of the valve 16. The controller 22 controls the fluid supply unit 20 and therefore controls the volume and pressure inside the bladder of the instability apparatus 14. The controller is integral to the person-support apparatus 10 in one embodiment while in another embodiment, the instability apparatus 14 has a dedicated controller 22. The controller 22 may be any programmable or pre-programmed device capable of providing or acquiring control signals. The instability apparatus 14 as shown in FIG. 6A and FIG. 6B is configured so that at least one of the bladders is differentially filled with fluid with respect to one other bladder in the seat support section SP. This differential volume of the bladders results in tilting of at least a portion of the seat support section SP as shown in FIG. 6B.

Figure 7A:
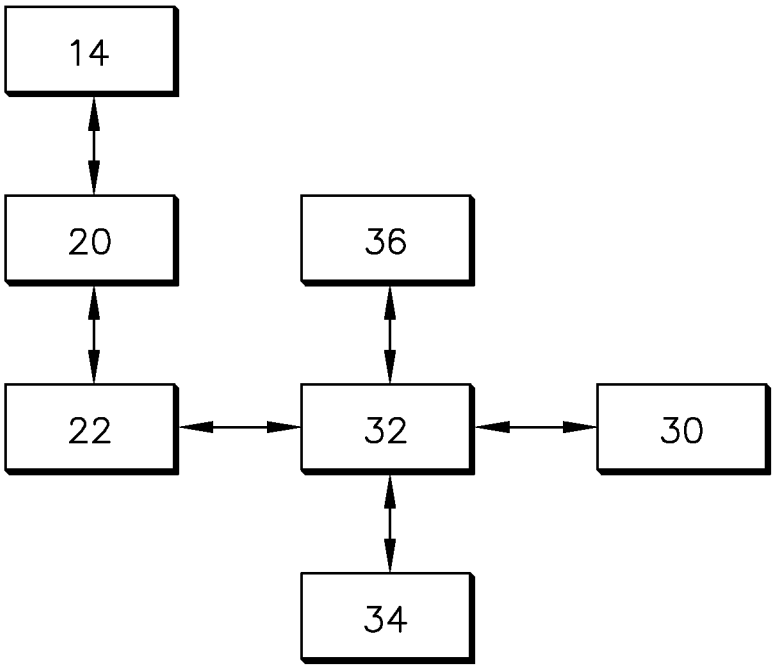
FIG. 7A is a schematic of one embodiment of a system to exercise a person's core region.

In one illustrative embodiment of the current disclosure as seen in FIG. 7A, an instability apparatus 14 comprises at least one bladder which is variably inflated and deflated by a fluid supply unit 20. A controller 22 communicates with and controls the operation of the fluid supply unit 20.The controller 22 is in communication with a communication network 32. The communication network 32 may be of any type, including but not limited to Wide Area Network (WAN), Local Area Network (LAN), Virtual Private Network (VPN), telephone lines, optical communications, internet communications or telex. The communication network 32 is in communication with at least one Electronic Medical Record (EMR) 30, a hospital communication station 36 and a nurse call system 34. The communication station 36 is a centralized location wherein one or more patients may be monitored by a caregiver. In one embodiment the communication station 36 may be stationary, while in another embodiment, it may be a mobile unit to accommodate prompt deployment.

Figure 7B:
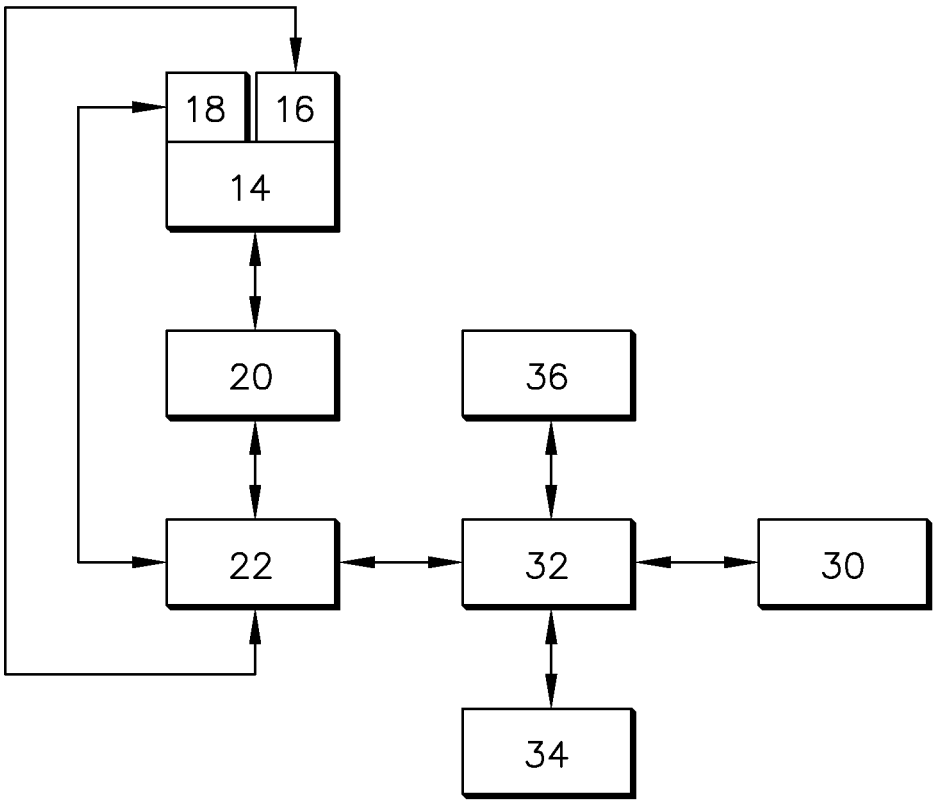
FIG. 7B is a schematic of another embodiment of a system to exercise a person's core region.

In another illustrative embodiment of the current disclosure as seen in FIG. 7B an instability apparatus 14 comprises at least one bladder which is variably inflated by a fluid supply unit 20. A controller 22 communicates with and controls the operation of the fluid supply unit 20. A pressure sensor 18 is mounted in the bladder and sends signals indicative of the pressure inside the bladder to the controller 22. In another embodiment, the pressure sensor 18 may be mounted external to the bladder. At least one valve 16 allows for variable deflation of the bladder in this embodiment. The controller 22 controls operation of the valve 16. Controller 22 is also in communication with a communication network 32. Communication network 32 may be of any type, including but not limited to Wide Area Network (WAN), Local Area Network (LAN), Virtual Private Network (VPN), telephone lines, optical communications, internet communications or telex. The communication network 32 is in communication with at least one Electronic Medical Record (EMR) 30, a hospital communication station 36 and a nurse call system 34.

The use of the terms "a" and "an" and "the" and similar referents in the context of describing the subject matter (particularly in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. Furthermore, the foregoing description is for the purpose of illustration only, and not for the purpose of limitation, as the scope of protection sought is defined by the claims as set forth hereinafter together with any equivalents thereof entitled to. The use of any and all examples, or exemplary language (e.g., "such as") provided herein, is intended merely to better illustrate the subject matter and does not pose a limitation on the scope of the subject matter unless otherwise claimed. The use of the term "based on" and other like phrases indicating a condition for bringing about a result, both in the claims and in the written description, is not intended to foreclose any other conditions that bring about that result. No language in the specification should be construed as indicating any non-claimed element as essential to the practice of the invention as claimed.

Preferred embodiments are described herein, including the best mode known to the inventor for carrying out the claimed subject matter. Of course, variations of those preferred embodiments will become apparent to those of ordinary skill in the art upon reading the foregoing description. The inventor expects skilled artisans to employ such variations as appropriate, and the inventor intends for the claimed subject matter to be practiced otherwise than as specifically described herein. Accordingly, this claimed subject matter includes all modifications and equivalents of the subject matter recited in the claims appended hereto as permitted by applicable law. Moreover, any combination of the above-described elements in all possible variations thereof is encompassed unless otherwise indicated herein or otherwise clearly contradicted by context.

The disclosures of any references and publications cited above are expressly incorporated by reference in their entireties to the same extent as if each were incorporated by reference individually.

We claim:

1. A system, comprising:

a person support surface comprising an upper layer with an outer facing surface and an inner facing surface, said inner facing surface enveloping an internal core region; and an inflatable instability apparatus mounted to said person support surface configured to cause instability, the inflatable instability apparatus supported by the internal core region and positioned to be under a central portion of a patient supported by the person support surface, the inflatable instability apparatus being inflatable to extend above the internal core region to suspend the portion of the patient above the internal core region so that a gap is formed between the patient and the internal core region on at least two sides of the inflatable instability apparatus.

2. The system of claim 1, said instability apparatus removably mounted on said person support surface.

3. The system of claim 2, said instability apparatus removably mounted on said person support surface using at least one of a snap connection, zippered connection, adhesive connection, frictional connection, or hook connection.

4. The system of claim 1, further comprising a person support apparatus supporting a portion of said person support surface.

5. The system of claim 1, said instability apparatus further comprising at least one bladder.

6. The system of claim 5, further comprising at least one valve configured to selectively retain a fluid in said bladder.

7. The system of claim 5, further comprising a blower configured to variably inflate said bladder.

8. The system of claim 5, further comprising a fluid supply unit fluidly connected to said bladder.

9. The system of claim 8, further comprising a controller, in communication with said fluid supply unit, said controller configured to operate said fluid supply unit to variably inflate said bladder.

10. A system, comprising:

a person support surface comprising a ticking layer with an outer facing surface and an inner facing surface, said inner facing surface defining an internal core region;

an instability apparatus mounted to said person support surface configured to cause instability, said instability apparatus further comprising at least one bladder;

a fluid supply unit fluidly connected to said bladder;

a controller in communication with said fluid supply unit, said controller configured to operate said fluid supply unit to variably inflate said bladder; and a nurse call system in communication with said controller.

11. A system, comprising:

a person support surface comprising a ticking layer with an outer facing surface and an inner facing surface, said inner facing surface defining an internal core region;

an instability apparatus mounted to said person support surface configured to cause instability, said instability apparatus further comprising at least one bladder;

a fluid supply unit fluidly connected to said bladder;

a controller in communication with said fluid supply unit, said controller configured to operate said fluid supply unit to variably inflate said bladder; and a communication network in communication with said controller.

12. The system of claim 11, further comprising a communication station in communication with said communication network.

13. The system of claim 11, further comprising an electronic medical record system in communication with said communication network.

14. The system of claim 1, said instability apparatus mounted on said outer facing surface.

15. The system of claim 1, said instability apparatus mounted on said inner facing surface.

16. The system of claim 1, said instability apparatus integral to said upper layer.

17. A system, comprising:

a person support apparatus;

a fluid supply unit mounted to said person support apparatus; and an inflatable instability apparatus in fluidic communication with said fluid supply unit, the inflatable instability apparatus supported on the person support apparatus and positioned to be under a central portion of a patient supported by the person support apparatus, the inflatable instability apparatus being inflatable to suspend the portion of the patient above the person support apparatus so that a gap is formed between the patient and the person support apparatus on at least two sides of the inflatable instability apparatus.

18. The system of claim 17, further comprising a controller in communication with said fluid supply unit.

19. The system of claim 17, further comprising a controller and the inflatable instability apparatus comprising a connector and at least one bladder configured to cause instability, the fluid supply being a source of pressurized fluid, the bladder in fluidic communication with said source of pressurized fluid, and the connector in the fluidic path between said bladder and said source of pressurized fluid.

20. The system of claim 19, further comprising a valve in the fluidic path between said bladder and said source of pressurized fluid in communication with said controller.

21. The system of claim 19, further comprising a person support surface comprising a ticking layer with an outer facing surface and an inner facing surface, said inner facing surface enveloping an internal core region.

22. The system of claim 21, said bladder mounted on said inner facing surface.

23. The system of claim 21, said bladder mounted on said outer facing surface.

24. The system of claim 21, said bladder integral to said ticking layer.

25. The system of claim 21, said bladder integral to said internal core region.

26. An instability apparatus for a person support surface, comprising:

at least two bladders positioned under a patient supported by the person support surface;

a fluid supply unit in fluidic communication with at least one bladder; at least one valve fluidly connected to at least one bladder; and a controller in communication with at least one of said fluid supply unit and said valve, said controller configured to vary volume of said fluid in at least one bladder to vary the inclination of said person support surface so that a gap is formed between the patient and the person support surface on at least two sides of at least one bladder to cause instability.

* * * * *